US005083519A

United States Patent [19]

Zebrowski

[11] Patent Number: 5,083,519

[45] Date of Patent: Jan. 28, 1992

[54] CARPET BINDING GUIDE APPARATUS

[76] Inventor: Michael Zebrowski, 12 Dock Ave., Waretown, N.J. 08758

[21] Appl. No.: 644,281

[22] Filed: Jan. 22, 1991

[51] Int. Cl.[5] ..... D05B 35/10

[52] U.S. Cl. ..... 112/153; 112/7

[58] Field of Search ..... 112/153, 136, 7; 33/42, 33/527

[56] References Cited

U.S. PATENT DOCUMENTS

| | | | |
|---|---|---|---|
| 2,554,168 | 5/1951 | Becker | 112/153 |
| 2,954,000 | 9/1960 | Gray | 112/153 |
| 4,062,307 | 12/1977 | Michelberger | 112/7 |
| 5,027,727 | 7/1991 | Ulmer | 112/153 |

*Primary Examiner*—Peter Nerbun
*Attorney, Agent, or Firm*—Leon Gilden

[57] ABSTRACT

An apparatus including a sewing machine head mounting a support plate, with the support plate orthogonally oriented relative to a reciprocating sewing needle, with the support plate including a forward edge, the support plate mounting a first "L" shaped plate thereunder, with the plate including a plurality of slots positioned forwardly and orthogonally relative to the forward end. A second "L" shaped plate has secured thereto a plurality of rods, the rods including fasteners, with the rods positionable through the slots to reciprocatingly position an abutment leg in an orthogonal orientation relative to the forward edge, with the abutment leg arranged generally parallel to the forward edge.

4 Claims, 4 Drawing Sheets

1
PRIOR ART

2
PRIOR ART

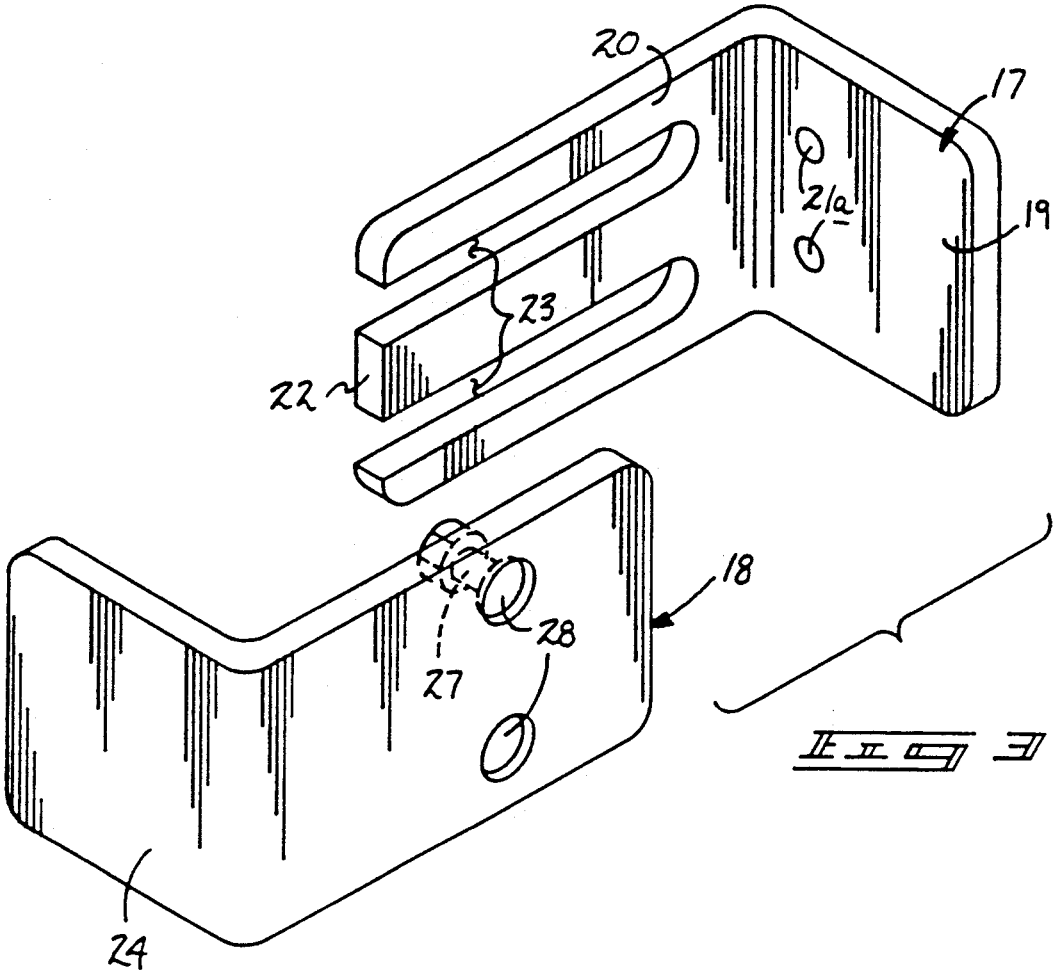
Fig 3
Fig 4
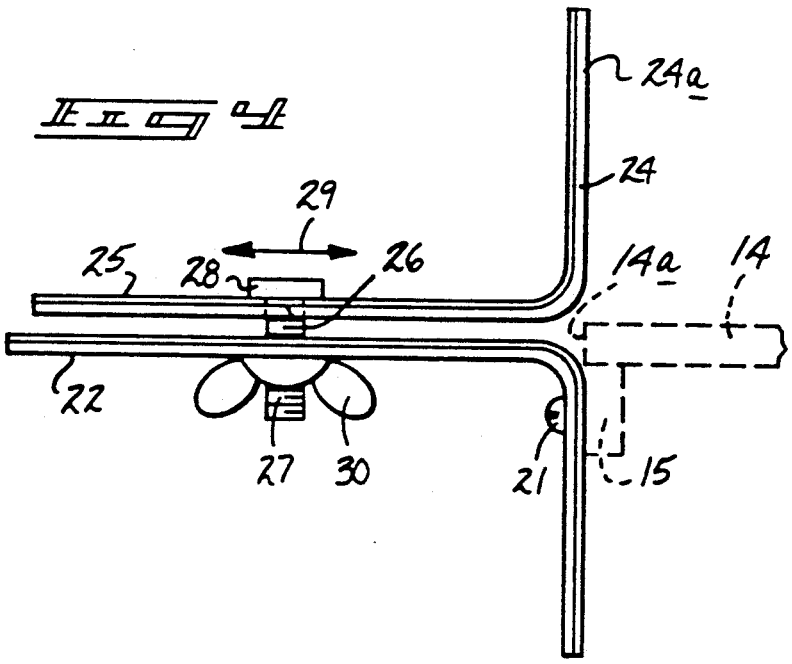

CARPET BINDING GUIDE APPARATUS

BACKGROUND OF THE INVENTION

1. Field of the Invention

The field of invention relates to sewing apparatus, and more particularly pertains to a new and improved carpet binding guide apparatus wherein the same orients a carpet edge relative to a sewing needle.

2. Description of the Prior Art

Various guide structure has been provided in the prior art to arrange positioning of carpeting members for various cutting and assembly procedures. Such apparatus is found in U.S. Pat. No. 3,678,586 to Weber for example, wherein a template provides an arcuate surface, projecting the arcuate surface above an underlying floor to provide a trimming edge for a carpet positioned thereon.

U.S. Pat. No. 4,143,463 to Trankle sets forth a further example providing a trim edge for carpeting relative to a floor.

U.S. Pat. No. 4,809,439 to Burns sets forth a gauge member for positioning the carpet against the baseboard during an assembly procedure.

As such, it may be appreciated that there continues to be a need for a new and improved carpet binding guide apparatus as set forth by the instant invention which addresses both the problems of ease of use as well as effectiveness in construction in assembling relative to a binding or sewing machine device to position in a parallel manner an edge of an associated carpeting relative to a seam to be directed through the carpet for binding of the carpet.

SUMMARY OF THE INVENTION

In view of the foregoing disadvantages inherent in the known types of carpet apparatus now present in the prior art, the present invention provides a carpet binding guide apparatus wherein the same orients in a parallel manner a carpet edge relative to a carpet web. As such, the general purpose of the present invention, which will be described subsequently in greater detail, is to provide a new and improved carpet binding guide apparatus which has all the advantages of the prior art carpet apparatus and none of the disadvantages.

To attain this, the present invention provides an apparatus including a sewing machine head mounting a support plate, with the support plate orthogonally oriented relative to a reciprocating sewing needle, with the support plate including a forward edge, the support plate mounting a first "L" shaped plate thereunder, with the plate including a plurality of slots positioned forwardly and orthogonally relative to the forward end. A second "L" shaped plate has secured thereto a plurality of rods, the rods including fasteners, with the rods positionable through the slots to reciprocatingly position an abutment leg in an orthogonal orientation relative to the forward edge, with the abutment leg arranged generally parallel to the forward edge.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved carpet binding guide apparatus which has all the advantages of the prior art carpet apparatus and none of the disadvantages.

It is another object of the present invention to provide a new and improved carpet binding guide apparatus which may be easily and efficiently manufactured and marketed.

It is a further object of the present invention to provide a new and improved carpet binding guide apparatus which is of a durable and reliable construction.

An even further object of the present invention is to provide a new and improved carpet binding guide apparatus which is susceptible of a low cost of manufacture with regard to both materials and labor, and which accordingly is then susceptible of low prices of sale to the consuming public, thereby making such carpet binding guide apparatus economically available to the buying public.

Still yet another object of the present invention is to provide a new and improved carpet binding guide apparatus which provides in the apparatus and methods of the prior art some of the advantages thereof, while simultaneously overcoming some of the disadvantages normally associated therewith.

Still another object of the present invention is to provide a new and improved carpet binding guide apparatus wherein the same conveniently and efficiently orients a carpet edge relative to a binding needle to effect linear sewing adjacent the carpet edge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the "L" shaped plates utilized by the instant invention.

FIG. 4 is an orthographic side view, taken in elevation, of the "L" shaped plates mounted relative to an associated sewing support plate.

DESCRIPTION OF THE PREFERRED EMBODIMENT

Figure 1:
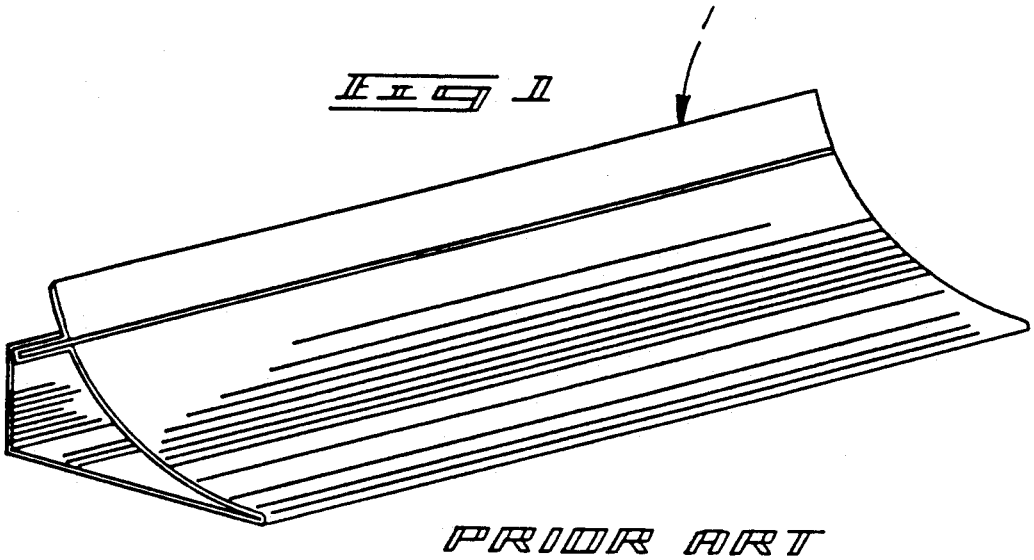
FIG. 1 is an isometric illustration of a prior art carpet template apparatus.

With reference now to the drawings, and in particular to FIGS. 1 to 7 thereof, a new and improved carpet binding guide apparatus embodying the principles and concepts of the present invention and generally designated by the reference numeral 10 will be described.

FIG. 1 illustrates a prior art carpet trimming template 1, as set forth in U.S. Pat. No. 3,678,586, providing an arcuate surface to the carpet portion portion upwardly thereof relative to a baseboard to provide the cutting edge in a properly spaced orientation relative to the carpet to position the carpet member relative to an associated baseboard.

Figure 2:
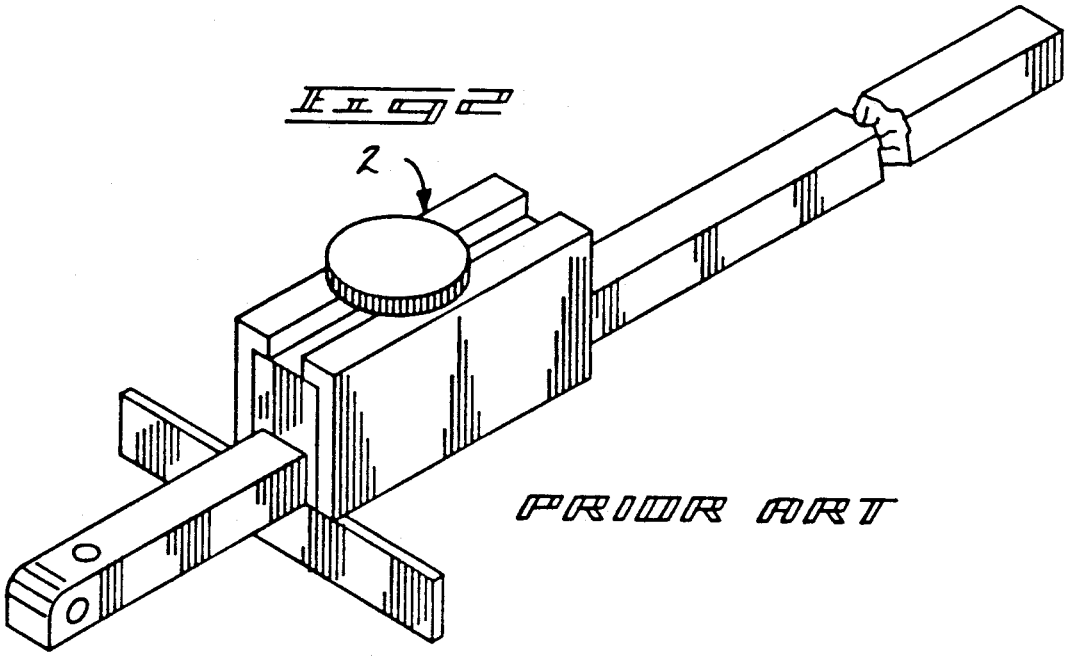
FIG. 2 is an isometric illustration of a further prior art example of a carpet guide organization.
Figure 5:
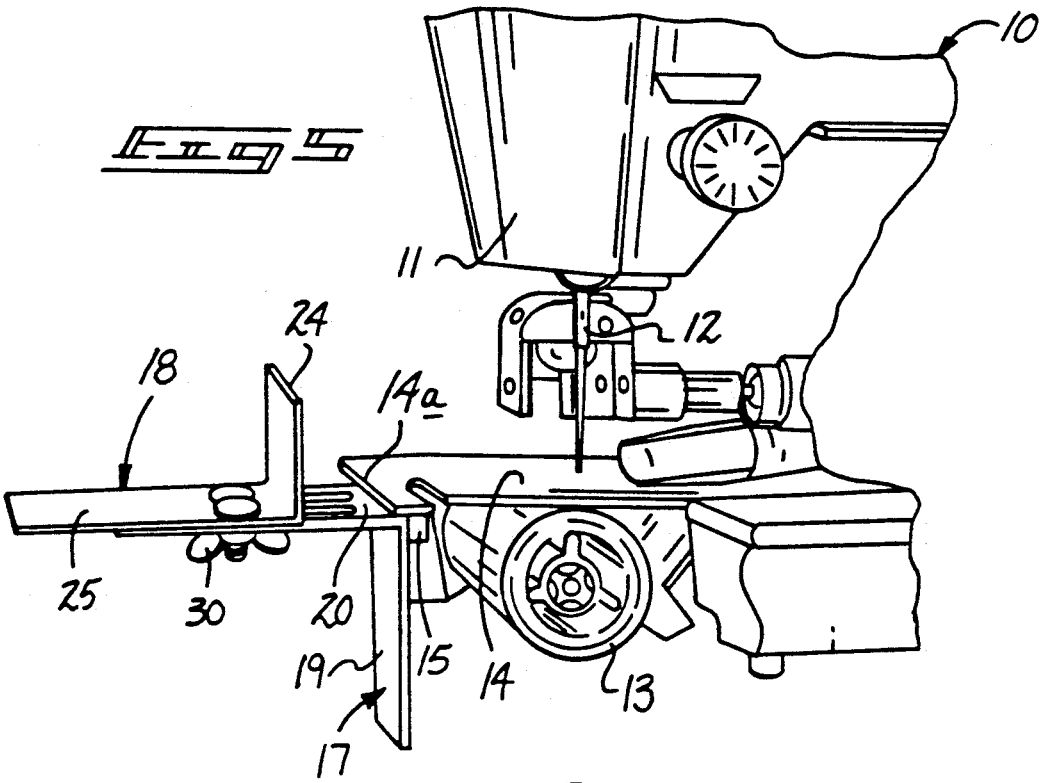
FIG. 5 is an isometric illustration of the instant invention.
Figure 6:
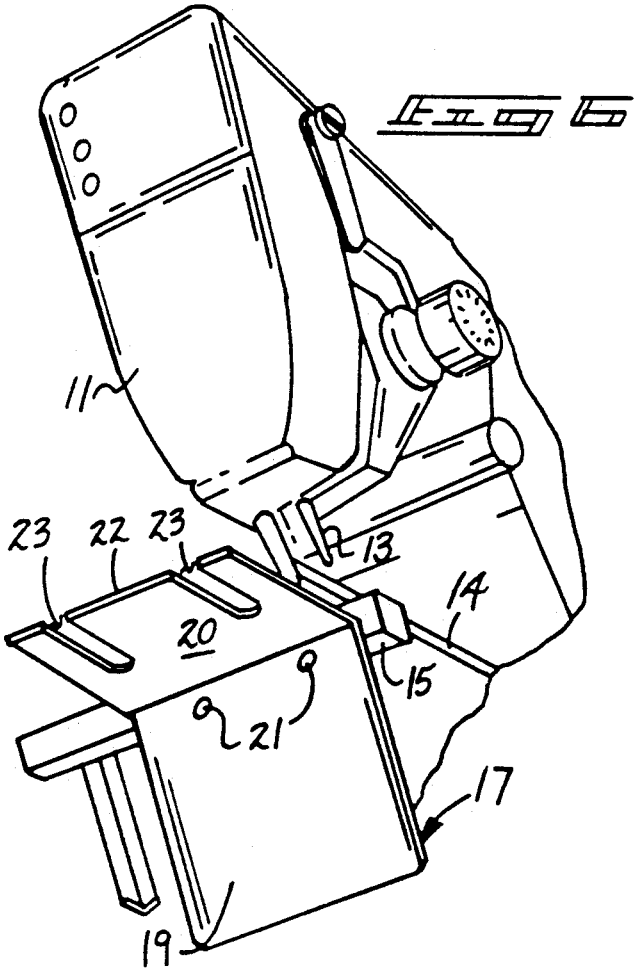
FIG. 6 is an isometric illustration of the instant invention illustrating the first "L" shaped plate mounted to the sewing machine support plate.
Figure 7:
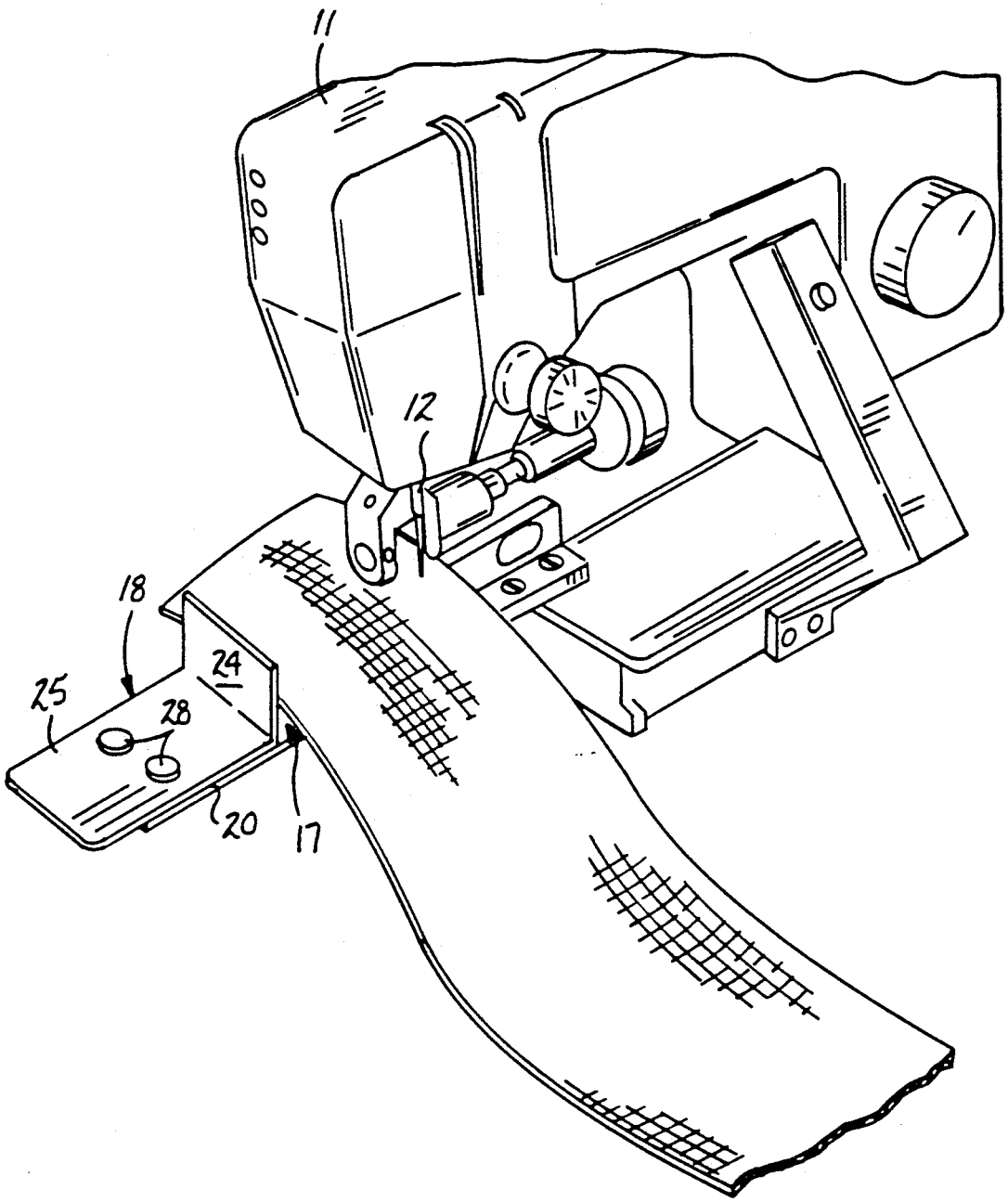
FIG. 7 is an isometric illustration of the instant invention illustrating the organization in operative association with a carpet member directed therethrough.

FIG. 2 illustrates a further prior art carpet apparatus 2 providing a gauge member, as set forth in U.S. Pat. No. 4,809,439, to provide measuring the size of a carpet module for adjoining a baseboard utilizing a rod having slidably mounted thereon a block encased in a bracket.

More specifically, the carpet binding guide apparatus 10 of the instant invention essentially comprises a fabric sewing machine head 11, including a reciprocating needle support 12 and associated needle that is reciprocatingly and orthogonally directed relative to an underlying sewing support plate 14. The drive motor 13 reciprocates the reciprocating needle support 12 and associated needle. The support plate 14 includes a support plate forward edge 14*a* spaced from the needle support 12. A mounting flange 15 is fixedly mounted underlying the support plate 14 adjacent the forward edge 14*a* with the flange arranged parallel to the forward edge 14*a*.

The guide structure includes a first "L" shaped plate 17 fixedly mounted to the flange 15 slidingly securing a second "L" shaped plate 18 thereon The first "L" shaped plate 17 includes a first leg 19 orthogonally and integrally mounted to a second leg 20 The first leg 19 includes a plurality of fasteners 21 directed through the first leg 19 adjacent an intersection of the first and second legs 19 and 20 through associated fastener bores 21*a* (see FIG. 3). The second leg 20 is defined by a second leg free edge 22*a* that is generally parallel relative to an exterior surface of the first leg 19 and includes a plurality of slots 23 that is orthogonally directed relative to the free edge 22 and extends longitudinally of the second leg 20. Slidably mounted to a top surface of the second leg 20 is the second "L" shaped plate 18. The second "L" shaped plate 18 includes an abutment plate leg 24 fixedly and orthogonally mounted to a slider plate 25 defining an "L" shaped configuration. The slider plate 25 includes a plurality of slider bores 26, each mounting an externally threaded fastener rod 27, with each fastener rod orthogonally and fixedly mounted to the slider plate 25 and extending interiorly of the second "L" shaped plate 18 between the abutment and slider plate legs 24 and 25. Internally threaded fasteners 30 permit clamping in a fixed orientation of the slider plate 25 relative to the second leg 20. The abutment leg 24 accordingly projects orthogonally relative to the second leg 20 and defines an abutment surface 24*a* parallel to the support plate forward edge 14*a* and wherein the abutment plate surface 24*a* is reciprocatable in an orthogonal orientation relative to the forward edge 14*a* in the direction of the directional arrow 29, as illustrated in FIG. 4. As illustrated, fastener heads 28 are fixedly mounted to the slider plate 25 to fixedly orient the externally threaded rods 27 projected through associated slider bores 26.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A carpet binding guide apparatus comprising, in combination, a fabric sewing machine head, wherein the sewing machine head includes a reciprocating needle support mounting a sewing needle therewithin, and a sewing support plate positioned underlying the reciprocating needle support, with the reciprocating needle support orthogonally oriented relative to the sewing support plate, and a drive motor positioned underlying the support plate effecting reciprocation of the reciprocating needle support, and the sewing support plate including a forward edge, and a mounting flange fixedly mounted underlying the sewing support plate arranged parallel to the forward edge, and a first "L" shaped plate fixedly mounted to the mounting flange, the first "L" shaped plate including a first leg extending orthogonally and downwardly relative to the sewing support plate, and a second leg extending parallel to the sewing machine support plate and orthogonally oriented relative to the forward edge, and a second "L" shaped plate slidably mounted to the second leg, with the second "L" shaped plate including an abutment plate, with the abutment plate including an abutment surface in confronting relationship relative to the forward edge and arranged parallel to the forward edge.

2. An apparatus as set forth in claim 1 wherein the abutment plate surface is reciprocatable relative to the forward edge in an orthogonal orientation relative to the forward edge.

3. An apparatus as set forth in claim 2 wherein the second leg of the first "L" shaped plate includes a second leg free edge, the second leg free edge arranged parallel to the forward edge, and a plurality of slots extending from the free edge longitudinally of the second leg and oriented orthogonally relative to the forward edge, and the second "L" shaped plate including a slider plate fixedly and orthogonally mounted to the abutment plate, with the slider plate including a plurality of threaded rods fixedly and orthogonally mounted to the slider plate, wherein each of said threaded rods extends through a respective slot, and an internally threaded fastener securable about each threaded rod for clamping the second leg between the internally threaded fastener and the slider plate.

4. An apparatus as set forth in claim 3 wherein the abutment plate extends above the sewing support plate and the forward edge.

* * * * *